US009653832B2

(12) United States Patent
Higashitani et al.

(10) Patent No.: US 9,653,832 B2
(45) Date of Patent: May 16, 2017

(54) CONDUCTIVE ELASTIC MEMBER AND CONNECTOR

(71) Applicant: YAZAKI CORPORATION, Tokyo (JP)

(72) Inventors: Masanobu Higashitani, Kakegawa (JP); Masayuki Kataoka, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 15/264,710

(22) Filed: Sep. 14, 2016

(65) Prior Publication Data

US 2017/0005427 A1 Jan. 5, 2017

Related U.S. Application Data

(63) Continuation of application No. PCT/JP2015/061911, filed on Apr. 17, 2015.

(30) Foreign Application Priority Data

Apr. 18, 2014 (JP) ..... 2014-086898

(51) Int. Cl.
*H01R 13/24* (2006.01)
*H01R 13/33* (2006.01)

(52) U.S. Cl.
CPC ..... *H01R 13/2414* (2013.01); *H01R 13/2407* (2013.01); *H01R 13/33* (2013.01)

(58) Field of Classification Search
CPC ..... H01R 13/2414
USPC ..... 439/86, 91
See application file for complete search history.

(56) References Cited

U.S. PATENT DOCUMENTS 3,795,037 A * 3/1974 Luttmer ..... H01R 12/714 174/541
3,934,959 A * 1/1976 Gilissen ..... H01R 31/00 439/66
4,003,621 A * 1/1977 Lamp ..... H01R 12/714 439/586
4,330,165 A * 5/1982 Sado ..... H01R 12/714 439/66
4,408,814 A * 10/1983 Takashi ..... H01R 13/2414 428/85

(Continued)

FOREIGN PATENT DOCUMENTS

JP 53-036150 B2 9/1978
JP 2953984 B2 9/1999

(Continued)

OTHER PUBLICATIONS

International Search Report for PCT/JP2015/061911 dated Jun. 23, 2015 [PCT/ISA/210].

(Continued)

*Primary Examiner* — Ross Gushi
(74) *Attorney, Agent, or Firm* — Sughrue Mion, PLLC

(57) ABSTRACT

A conductive elastic member is formed by having a columnar member having elasticity, and plural wire rods which extend from one end face to the other end face of the columnar member in an axial direction and are formed in a state inclined with respect to the axial direction and have conductivity. At least a part of the plural wire rods are cabled in a direction of intersection mutually.

8 Claims, 13 Drawing Sheets

(56) References Cited

U.S. PATENT DOCUMENTS 4,449,774 A * 5/1984 Takashi ..... B29C 47/0004 428/85
4,520,562 A * 6/1985 Sado ..... B29C 70/72 174/117 F
4,636,018 A * 1/1987 Stillie ..... H01R 12/714 439/592
4,754,546 A * 7/1988 Lee ..... H01R 13/2414 29/877
5,101,553 A * 4/1992 Carey ..... H01R 13/2435 29/530
5,385,477 A * 1/1995 Vaynkof ..... G01R 1/07357 439/591
5,403,194 A * 4/1995 Yamazaki ..... B29C 43/18 439/591
5,427,535 A * 6/1995 Sinclair ..... H01R 13/2414 439/66
5,441,690 A * 8/1995 Ayala-Esquilin ..... H01B 3/46 156/155
5,788,516 A * 8/1998 Uggmark ..... H01R 13/2414 439/63
5,810,607 A * 9/1998 Shih ..... H01R 13/2414 439/66
5,904,580 A * 5/1999 Kozel ..... H01R 12/52 439/66
6,017,225 A * 1/2000 Michiya ..... H04R 1/08 439/86
6,019,610 A * 2/2000 Glatts, III ..... H01R 13/2414 439/66
6,106,305 A * 8/2000 Kozel ..... H01R 13/2435 439/66
6,264,476 B1 * 7/2001 Li ..... G01R 1/06716 439/66
6,286,208 B1 * 9/2001 Shih ..... H01R 13/2414 29/848
6,350,132 B1 * 2/2002 Glatts, III ..... H01R 13/2414 29/850
6,712,620 B1 * 3/2004 Li ..... H01R 13/2414 439/394
7,040,902 B2 * 5/2006 Li ..... H01R 13/2464 257/E23.067
7,156,669 B2 * 1/2007 Asai ..... G01R 1/07371 257/E21.514
7,384,271 B1 * 6/2008 Mickievicz ..... H01R 12/714 439/66
7,537,459 B2 * 5/2009 Takegahara ..... H01R 4/04 439/66
7,833,020 B1 * 11/2010 Ma ..... H01R 13/2407 439/66
8,435,044 B2 * 5/2013 Balucani ..... G01R 1/06716 439/66
8,742,260 B2 * 6/2014 Sato ..... H01R 13/2414 174/254
9,004,928 B2 * 4/2015 Tanaka ..... B60L 3/0069 439/86
9,160,094 B2 * 10/2015 Yamada ..... H01R 13/2414
9,484,699 B2 * 11/2016 Shedletsky ..... H01R 13/2414
2004/0049914 A1 * 3/2004 Wang ..... H01R 13/2414 29/884
2013/0040473 A1 2/2013 Tanaka et al.

FOREIGN PATENT DOCUMENTS

JP 2992208 B2 12/1999
JP 2006-108039 A 4/2006
JP 2008-059895 A 3/2008
JP 2012-094263 A 5/2012

OTHER PUBLICATIONS

Written Opinion for PCT/JP2015/061911 dated Jun. 23, 2015 [PCT/ISA/237].
International Preliminary Report/Written Opinion dated Oct. 27, 2016 issued by the International Searching Authority in counterpart International Patent Application No. PCT/JP2015/061911 (PCT/IB/338/373 & PCT/ISA/237).

* cited by examiner

CONDUCTIVE ELASTIC MEMBER AND CONNECTOR

CROSS REFERENCE TO RELATED APPLICATIONS

This application is a continuation of PCT application No. PCT/JP15/061911, which was filed on Apr. 17, 2015 based on Japanese Patent Application (No. 2014/086898) filed on Apr. 18, 2014, the contents of which are incorporated herein by reference.

BACKGROUND OF THE INVENTION

1. Field of the Invention

The present invention relates to a conductive elastic member and a connector using this member.

2. Description of the Related Art

Conventionally, a known terminal connecting structure of making electrical connection between terminals of two electrical devices is a structure of making electrical connection between two terminals through conductive rubber. Patent Literature 1 discloses a technique using conductive rubber in connection between terminals of a motor and an inverter installed in an electric vehicle etc.

In the connecting structure disclosed in Patent Literature 1, the terminal of the motor side and the terminal of the inverter side are respectively held in different connector housings, and the columnar conductive rubber is accommodated in the connector housing of the motor side in a situation in which the conductive rubber is placed on the terminal of the motor side. At the time of fitting the two connector housings, connection between the terminal of the motor side and the terminal of the inverter side is made in a state in which the conductive rubber is pressed from a vertical direction and is compressed and deformed. By compressing and deforming the conductive rubber, the conductive rubber accommodates tolerance variations in inclination, positions, etc. of both terminals at the time of fitting, and ensures connection to both of the terminals.

Patent Literature 1: JP-A-2012-94263

SUMMARY OF INVENTION

Incidentally, the conductive rubber described in Patent Literature 1 exhibits conductivity by adding conductive powder, conductive carbon black, etc. to a rubber material. On the other hand, conductive rubber formed by inserting many conductive wire rods into a columnar member made of rubber is contemplated as a new technique associated with an increase in voltage between terminals. FIGS. 13A and 13B show one example of a cross-sectional structure of conductive rubber.

In conductive rubber 71 shown in FIGS. 13A and 13B, terminals are respectively brought into contact with both axial end faces 72, 73 of the conductive rubber formed in a columnar shape. Plural wire rods 74 cabled in substantially parallel with an axial direction are cabled inside the conductive rubber. Each of the wire rods 74 is constructed so that contact points are formed by being respectively exposed from both end faces 72, 73, for example, in a flush state and the terminals respectively brought into contact with both end faces 72, 73 are brought into conduction. However, in this kind of conductive rubber 71, a compression direction by the terminals substantially matches with a cabling direction of the wire rod, with the result that compressive deformation of the conductive rubber is inhibited by the wire rods 74.

On the other hand, a structure in which wire rods 74 are cabled in a state inclined with respect to an axial direction of conductive rubber 75 is contemplated as shown in FIGS. 14A and 14B. In the case of cabling the wire rods 74 in the inclined state in this manner, inclinations of the wire rods 74 are changed into a state of FIG. 14A to FIG. 14B so as to follow stress in the compression direction. As a result, the conductive rubber 75 can be compressed and deformed while bringing terminals into conduction.

However, in the case of cabling the wire rods 74 in the inclined state as shown in FIGS. 14A and 14B, a region (dotted-line portions of FIGS. 14A and 14B) without contributing to energization occurs in both end faces of the conductive rubber and further, a contact point region (exposed region of the wire rods 74) contributing to energization is formed in a position distant from the axis of the conductive rubber. As a result, for example, depending on inclination or a position of the terminal at the time of fitting a connector housing, contact between the terminal and a contact point of the conductive rubber becomes non-uniform, and reliability of contact between the conductive rubber and the terminal may be damaged.

The invention has been implemented in view of such a problem, and a problem of the invention is to increase reliability of contact between wire rods and a terminal.

The above problem of the invention is solved by configurations of the following (1) to (5).

(1) A conductive elastic member comprising:

a columnar member having elasticity; and plural wire rods having conductivity, extending from one end face to the other end face of the columnar member in an axial direction thereof, and inclined with respect to the axial direction, wherein the wire rods have plural first wire rods and second wire rods cabled in parallel mutually along a direction substantially orthogonal to the axial direction, the first wire rods and the second wire rods are respectively cabled along opposed side surfaces of a virtual truncated pyramid extending through the columnar member, and each of the wire rods of the first wire rods and each of the wire rods of the second wire rods are respectively formed so as to be joined on an upper base side of the virtual truncated pyramid by third wire rods cabled along the other end face.

(2) A conductive elastic member comprising:

a columnar member having elasticity; and plural wire rods having conductivity, extending from one end face to the other end face of the columnar member in an axial direction thereof, and inclined with respect to the axial direction, wherein the wire rods are cabled along a side surface of a virtual truncated cone extending through the columnar member.

(3) A conductive elastic member comprising:

a columnar member having elasticity; and plural wire rods having conductivity, extending from one end face to the other end face of the columnar member in an axial direction thereof, and inclined with respect to the axial direction, wherein the wire rods are mutually intersected in a middle of the columnar member in the axial direction and are respectively cabled in a conical shape from the intersected portion toward both of the end faces.

(4) The conductive elastic member according to the above (3), wherein, when the columnar member is divided by a plane including an axis, a ratio between exposed areas of the wire rods exposed to both of the end faces of each of the divided columnar members in the axial direction is identical in an allowable range.

(5) A connector comprising:

a first housing for holding one terminal;

a second housing for holding the other terminal; and a conductive elastic member accommodated in one of the first housing and the second housing, wherein, when the first housing is fitted into the second housing, the conductive elastic member comes in contact with the one terminal and the other terminal so as to electrically connect the one terminal and the other terminal through the conductive elastic member, and the conductive elastic member is the conductive elastic member according to the above (1) to (4).

DETAILED DESCRIPTION OF THE EXEMPLARY EMBODIMENTS

One embodiment of a connector to which the invention is applied will hereinafter be described with reference to the drawings. The connector of the present embodiment is applied to a connecting device for making electrical connection between a terminal of a motor installed in an electric vehicle, a hybrid car, etc. and a terminal of an inverter for outputting electric power, a control signal, etc. to the motor, but the connector of the invention is not limited to this, and can be applied to various connecting devices for making connection between terminals of various electrical devices.

Figure 1:
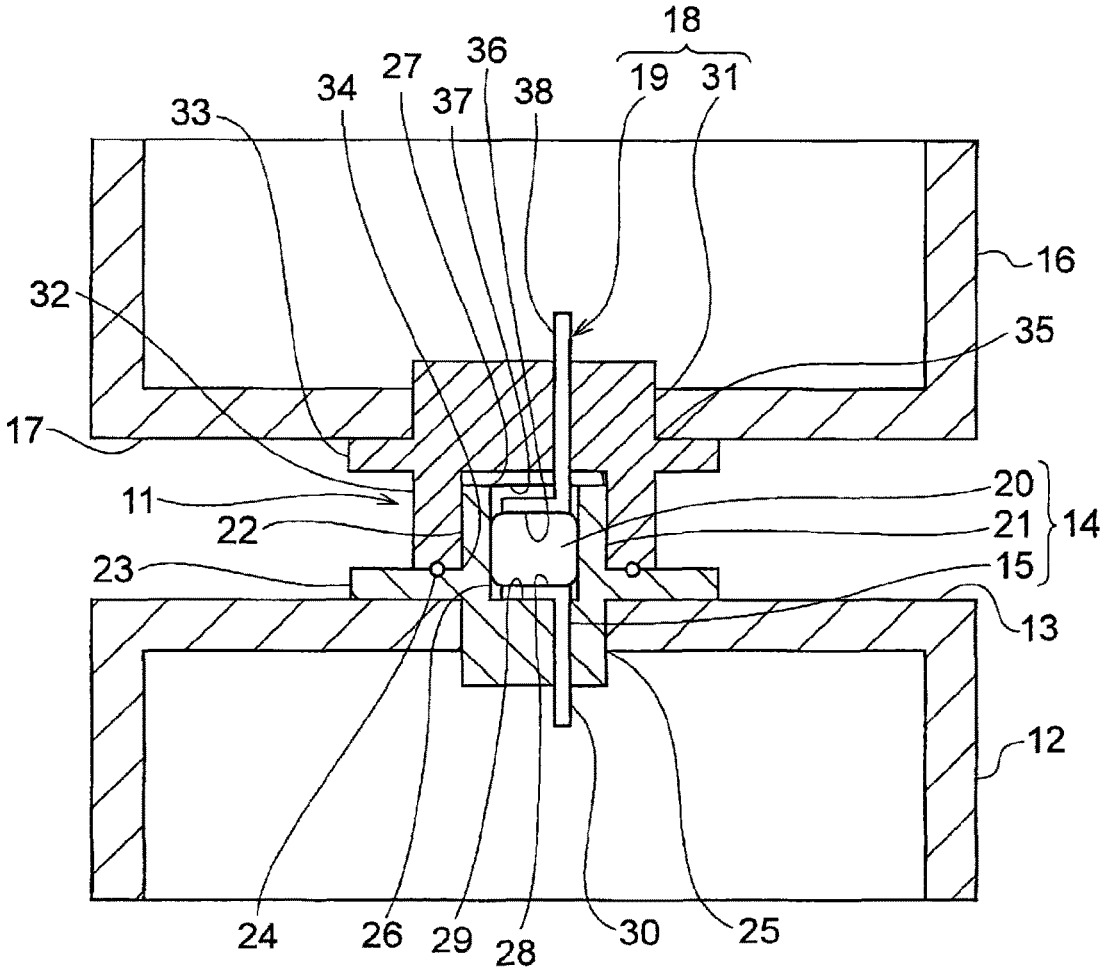
FIG. 1 is a sectional view of a connector to which the invention is applied.

As shown in FIG. 1, a connector 11 of the embodiment includes a first connector 14 fixed to an upper wall 13 of a cabinet 12 for accommodating a motor, a first terminal 15 held in the first connector 14, a second connector 18 fixed to a lower wall 17 of a cabinet 16 for accommodating an inverter, a second terminal 19 held in the second connector 18, and a conductive elastic member 20 which is accommodated in the first connector 14 and has conductivity.

The conductive elastic member 20 makes electrical connection between the first terminal 15 and the second terminal 19 by being respectively pressed and compressed and deformed by the first terminal 15 and the second terminal 19 at the time of fitting the first connector 14 into the second connector 18. In the following explanation, the motor side is set in a downward direction, and the inverter side is set in an upward direction, and an axial direction of the conductive elastic member 20 is set in a vertical direction. However, these arrangement relations are not limited to the vertical direction, and may be arranged in a horizontal direction.

The first connector 14 includes a first housing 21 made of an insulating resin, the first terminal (one terminal) 15 with an L shape supported inside the first housing 21, and the conductive elastic member 20 accommodated inside the first housing 21. The first housing 21 includes a tubular part 22 with an angular tube shape extending in the axial direction, a flange part 23 circumferentially projected from an outer peripheral surface of the tubular part 22, and annular waterproof packing 24 attached to the inside of a peripheral groove of an upper surface of the flange part 23 so as to surround the flange part 2 In addition, a plurality (for example, three) of the first terminals 15 and the conductive elastic members 20 are respectively held in the first connector 14, and the same number of second terminals 19 are held in the second connector 18, but in the embodiment, an example of respectively accommodating these components by one will be described for ease of explanation.

The first housing 21 is formed with a bolt insertion hole in a bracket (not shown) extending to the left and right, and the tubular part 22 is inserted into an opening 25 formed in the upper wall 13 of the cabinet 12, and a bolt inserted into the bolt insertion hole is fastened and fixed to the upper wall 13 in a situation in which a lower surface of the flange part 23 makes contact with the upper wall 13. For example, a gap between an inner peripheral surface of the opening 25 and the outer peripheral surface of the tubular part 22 is formed with a waterproof structure (not shown).

The first terminal 15 is accommodated in an accommodating part 26 formed in the tubular part 22 of the first connector 14. The accommodating part 26 is space with a rectangular parallelepiped shape formed in the back (lower side) of an opening 27 of the upper end of the tubular part 22. A contact part 28 bent in an L shape is brought into contact with a bottom part 29 facing the back of the accommodating part 26 to thereby support the first terminal 15. A linear proximal end 30 continuously orthogonal to the contact part 28 is constructed so as to be drooped through a through hole of the bottom part 29 and be pulled out of the tubular part 22.

In the conductive elastic member 20, a material having elasticity is used as a base material, and plural wire rods having conductivity described below are included in the base material. The conductive elastic member 20 can be manufactured by, for example, insert molding and secondary processing of the molded product. The conductive elastic member 20 has an anisotropic conductive rubber structure having elasticity resulting from the base material and conductivity resulting from the wire rods. As the base material, thermoplastic or thermosetting synthetic rubber or synthetic resin is used and, concretely, thermoplastic or thermosetting elastomer etc. can be used, but the base material is not particularly limited as long as the base material is a material having elasticity. The base material can also be provided with conductivity by adding carbon powder etc.

Each of the wire rods is formed with electrical contact points on both end faces by being exposed from both end faces so as to extend from one end face to the other end face of the conductive elastic member 20 in the axial direction. Also, the conductive elastic member 20 is constructed so as to be able to be axially compressed and deformed under a lower load since each of the wire rods is formed in a state inclined with respect to the axial direction. The contact part 28 of the first terminal 15 makes contact with a lower end surface of the conductive elastic member 20, and the conductive elastic member 20 is accommodated in a accommodating part 26 in a situation placed on the contact part 28.

The second connector 18 includes a second housing 31 made of an insulating resin, and the second terminal (the other terminal) 19 with an L shape supported inside the second housing 31. The second housing 31 includes a tubular part 32 with an angular tube shape extending in the axial direction, and a flange part 33 circumferentially projected from an outer peripheral surface of the tubular part 32. The tubular part 32 is constructed so that the tubular part 22 of the first connector 14 can be fitted into space with a rectangular parallelepiped shape formed in the back (upper side) of an opening 34 of the lower end.

The second housing 31 is formed with a bolt insertion hole in a bracket (not shown) extending to the left and right, and the tubular part 32 is inserted into an opening 35 formed in the lower wall 17 of the cabinet 16, and a bolt inserted into the bolt insertion hole is fastened and fixed to the lower wall 17 in a situation in which an upper surface of the flange part 33 makes contact with the lower wall 17. For example, a gap between an inner peripheral surface of the opening 35 and the outer peripheral surface of the tubular part 32 is formed with a waterproof structure (not shown).

A contact part 36 bent in an L shape extends in substantially a horizontal direction along a bottom part 37 at a distance to the bottom part 37 facing the back of the space with the rectangular parallelepiped shape formed in the tubular part 32 to thereby support the second terminal 19. A proximal end 38 continuously orthogonal to the contact part 36 is constructed so as to be pulled out of the tubular part 32 through a through hole of the bottom part 37. The second terminal 19 is formed in a position contactable with the conductive elastic member 20 at the time of fitting the first connector 14 into the second connector 18 as described below.

As shown in FIG. 1, when the first connector 14 and the second connector 18 are changed into a normal fitting state (hereinafter simply called a fitting state), the tubular part 22 of the first housing 21 is fitted into the tubular part 32 of the second housing 31 and also, the tubular part 32 is placed on the flange part 23 of the first connector 14 through the waterproof packing 24. At this time, a gap between the first connector 14 and the second connector 18 is sealed with the waterproof packing 24.

Figure 2:
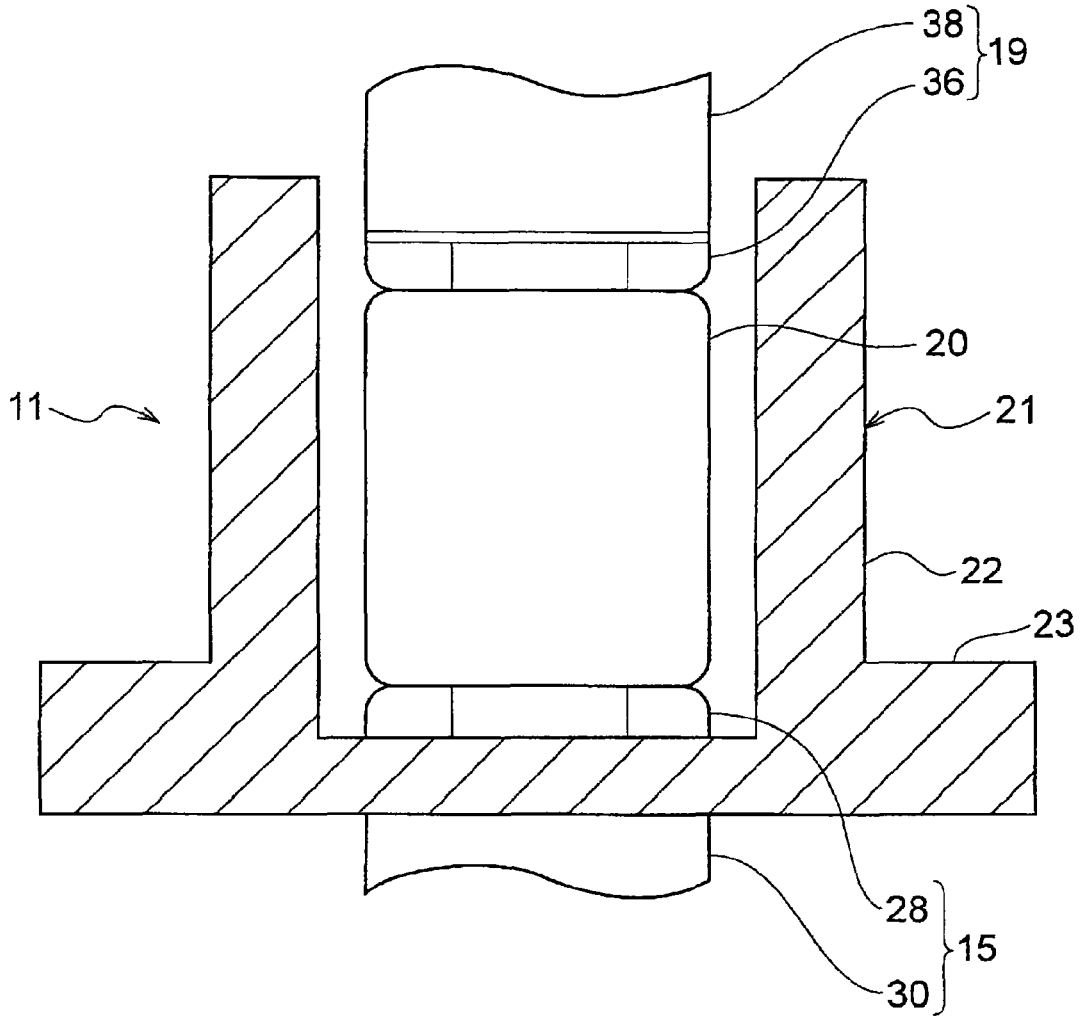
FIG. 2 is an enlarged view showing a main part of the connector to which the invention is applied.

On the other hand, as shown in FIG. 2, inside the connector 11, in the fitting state, the contact part 36 of the second terminal 19 downwardly presses an upper end face of the conductive elastic member 20, and the contact part 28 of the first terminal 15 upwardly presses a lower end face of the conductive elastic member 20. Accordingly, the conductive elastic member 20 is pinched between the first terminal 15 and the second terminal 19 and is axially compressed and deformed, and electrical connection between the first terminal 15 and the second terminal 19 is made through the conductive elastic member 20.

According to the connector 11 of the embodiment as described above, when the first housing 21 is fitted into the second housing 31, the conductive elastic member 20 is pinched between the first terminal 15 and the second terminal 19 and is elastically deformed, with the result that tolerance variations in inclination, positions, etc. of the first and second terminals 15, 19 can be accommodated. Accordingly, regardless of magnitude of the tolerance variations of the first and second terminals 15, 19, connection between the first and second terminals 15, 19 and contact points of the conductive elastic member 20 can be ensured. Also, for example, even when the connector 11 vibrates at the time of fitting, the compressed conductive elastic member 20 absorbs vibration to thereby stably hold a state of the connection between the first and second terminals 15, 19 and the contact points of the conductive elastic member 20.

Next, an internal structure of the conductive elastic member 20 having a characterizing configuration of the embodiment will be described according to examples.

EXAMPLE 1

Figure 3:
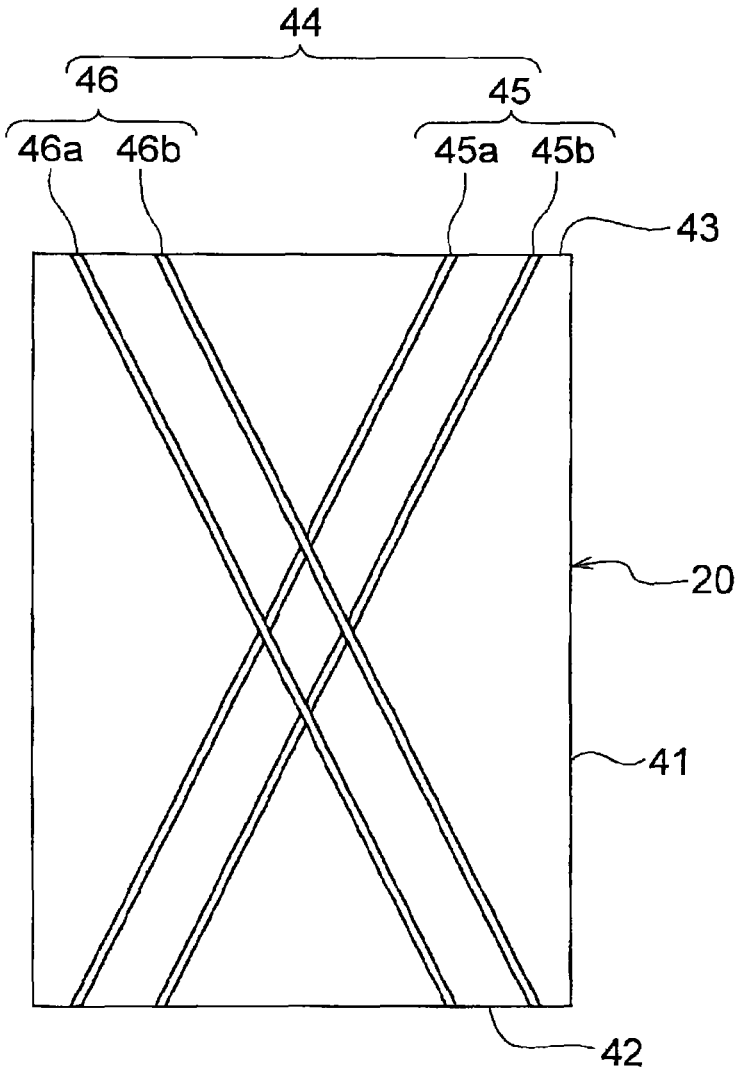
FIG. 3 is a longitudinal sectional view showing one example of an internal structure of a conductive elastic member according to an embodiment of the invention.

FIG. 3 is a longitudinal sectional view showing an internal structure of the conductive elastic member 20. The conductive elastic member 20 has a columnar member 41 with a rectangular parallelepiped shape, and plural conductive wire rods 44 extending from a lower end face (one end face) 42 to an upper end face (the other end face) 43 of the columnar member 41 in an axial direction. Each of the wire rods 44 uses a conductive (for example, metal) wire etc., and is formed in substantially a linear shape. End faces of each of the wire rods 44 is formed so as to be respectively exposed to the upper end face 43 and the lower end face 42 of the columnar member 41, for example, in substantially a flush state.

Each of the wire rods 44 has plural first wire rods 45 cabled mutually in parallel so as to overlap in a projection direction (direction of the paper back of FIG. 3) substantially orthogonal to the axial direction of the conductive elastic member 20, and plural second wire rods 46 cabled mutually in parallel so as to overlap in this projection direction. The first wire rods 45 and the second wire rods 46 are formed in a state inclined with respect to the axial direction of the columnar member 41, and are cabled at mutually different cabling angles of the wire rods 44 with respect to the axial direction (hereinafter simply called a cabling angle). In the case of the embodiment, the first wire rods 45 and the second wire rods 46 are cabled in a net state in a direction of intersection in an X shape in the projection direction.

As shown in FIG. 3, in the first wire rod 45, along a plane substantially orthogonal to the projection direction, that is, a plane in substantially parallel with the axial direction, two mutually parallel first wire rods 45*a*, 45*b* are cabled to form a layer and also in the second wire rod 46, two second wire rods 46*a*, 46*b* are cabled to form a layer. In addition, the first wire rods 45*a*, 45*b* and the second wire rods 46*a*, 46*b* cabled in each of the layers may be respectively intersected in the X shape in the projection direction and also, the number of wire rods is not limited to two.

In FIG. 3, the columnar member 41 is formed in the rectangular parallelepiped shape, but is not limited to this shape as long as both end faces in the axial direction are formed mutually in substantially parallel (substantially a horizontal direction), and the columnar member 41 may also be formed in a circularly columnar shape etc.

Figure 4A:
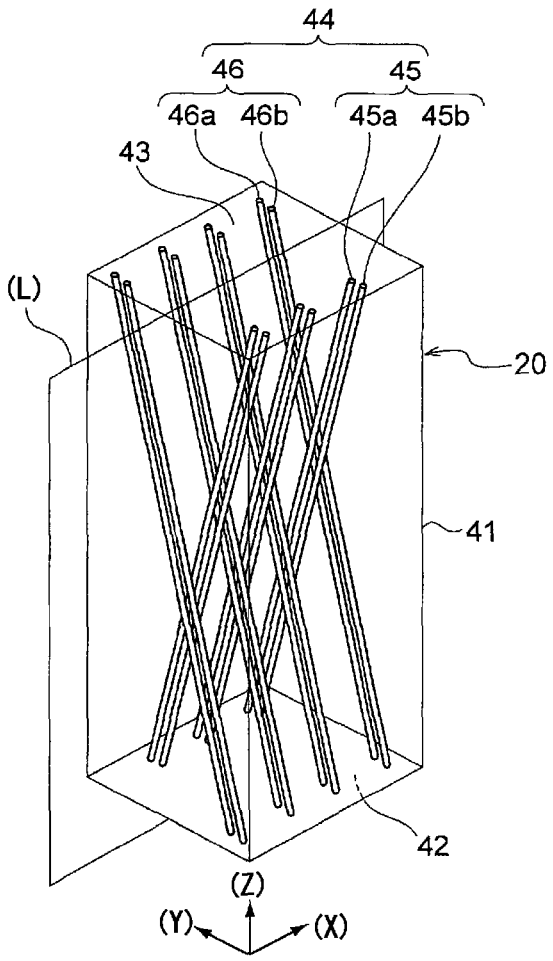
FIGS. 4A and 4B are a perspective view and a perspective plan view showing one example of the internal structure of the conductive elastic member according to the embodiment of the invention.

FIGS. 4A to 5B are perspective views showing one example of the internal structure of the conductive elastic member 20 shown in FIG. 3, and are respectively represented from two directions of a perspective direction and a plane direction. In FIGS. 4A and 4B, a layer made of the first wire rods 45*a*, 45*b* and a layer made of the second wire rods 46*a*, 46*b* are mutually spaced in an (X) direction and are alternately cabled in an X shape. On the other hand, in FIGS. 5A and 5B, the first wire rods 45*a*, 45*b* and the second wire rods 46*a*, 46*b* adjacent in the (X) direction are mutually overlapped in the X shape to thereby form a layer in which the four wire rods are cabled, and the layers are mutually spaced in the (X) direction and are repeatedly cabled.

In configurations of FIGS. 4A to 5B, the first wire rods 45 and the second wire rods 46 respectively exposed from the lower end face 42 and the upper end face 43 of the conductive elastic member 20 are arranged substantially symmetrically with respect to a plane (L) including the axis of the conductive elastic member 20, and a ratio between exposed areas of the first wire rods 45 and the second wire rods 46 exposed to the lower end face 42 and the upper end face 43 of each of the columnar members, divided by the plane (L), in the axial direction is identical in an allowable range. Accordingly, in the conductive elastic member 20, an exposed region (contact point region) of the wire rods 44 in the lower end face 42 and the upper end face 43 is arranged substantially equally widely, with the result that a region of contact between the first terminal 15 and the second terminal 19 and contact points of the wire rods 44 can be ensured widely uniformly.

Moreover, in the conductive elastic member 20, the first wire rods 45 and the second wire rods 46 are respectively cabled in a state inclined with respect to the axial direction. Hence, cabling angles of each of the first wire rods 45 and the second wire rods 46 are independently changed so as to follow compression of the conductive elastic member 20 in the axial direction. Accordingly, in the first wire rods 45 and the second wire rods 46, predetermined amounts of deformation are caused so as to correspond to stress distribution on a surface acting on the lower end face 42 and the upper end face 43 of the conductive elastic member 20, and desired elasticity and flexibility are ensured. Hence, tolerance variations in inclination, a position, etc. of the second terminal 19 in a fitting state can be accommodated by compressive deformation or bending deformation of the conductive elastic member 20.

Consequently, in the conductive elastic member 20 of Example 1, the first terminal 15 and the second terminal 19 can uniformly be pushed on the lower end face 42 and the upper end face 43 of the conductive elastic member 20 and further, the contact point region of the lower end face 42 and the upper end face 43 can be ensured widely. Hence, an area of contact between the first terminal 15 and the second terminal 19 and the contact points can be ensured more than a setting, and contact reliability can be increased.

Figure 4B:
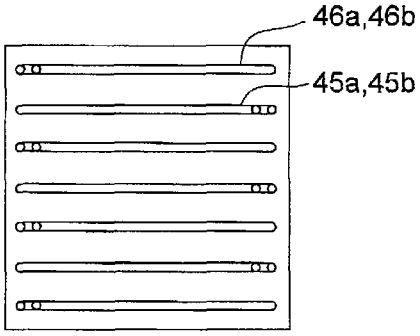

Also, as in the configurations shown in FIGS. 4A to 5B, particularly, the configuration shown in FIGS. 4A and 4B, the layers with different cabling angles are mutually spaced and are alternately cabled and thereby, a base material can regularly be interposed between the layers, with the result that a design guarantee against deformation of the conductive elastic member 20 can be provided easily.

Figure 5A:
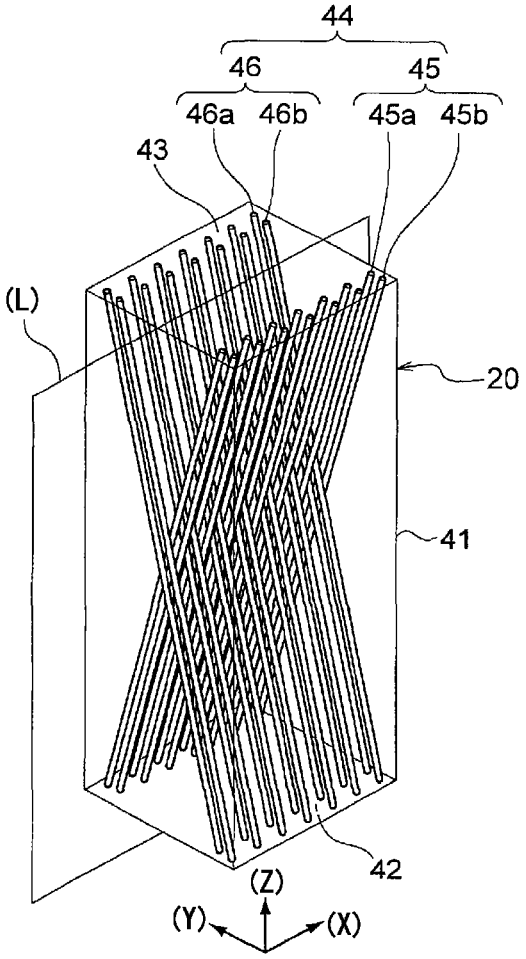
FIGS. 5A and 5B are a perspective view and a perspective plan view showing one example of an internal structure of a conductive elastic member according to the embodiment of the invention.
Figure 5B:
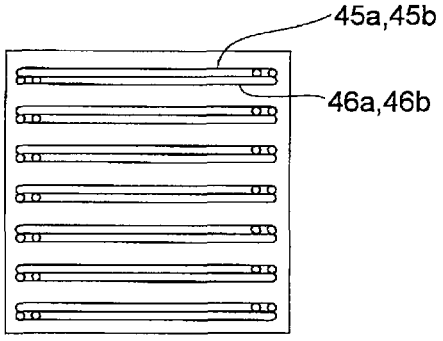

Also, as shown in FIGS. 5A and 5B, since a parallel circuit can be formed by bringing the first wire rods 45 into contact with the second wire rods 46 and cabling the first wire rods 45 and the second wire rods 46, current-carrying resistance of each of the wire rods 44 can be decreased. And, since the number of wire rods 44 cabled (cabling density) can be increased by bringing the first wire rods 45 into contact with the second wire rods and cabling the first wire rods 45 and the second wire rods, the conductive elastic member 20 can be miniaturized.

EXAMPLE 2

Next, an example of an internal structure of another conductive elastic member will be described. In addition, in the following explanation, explanation is omitted by assigning the same numerals to components common to those of the conductive elastic member 20 of Example 1 described above.

Figure 6:
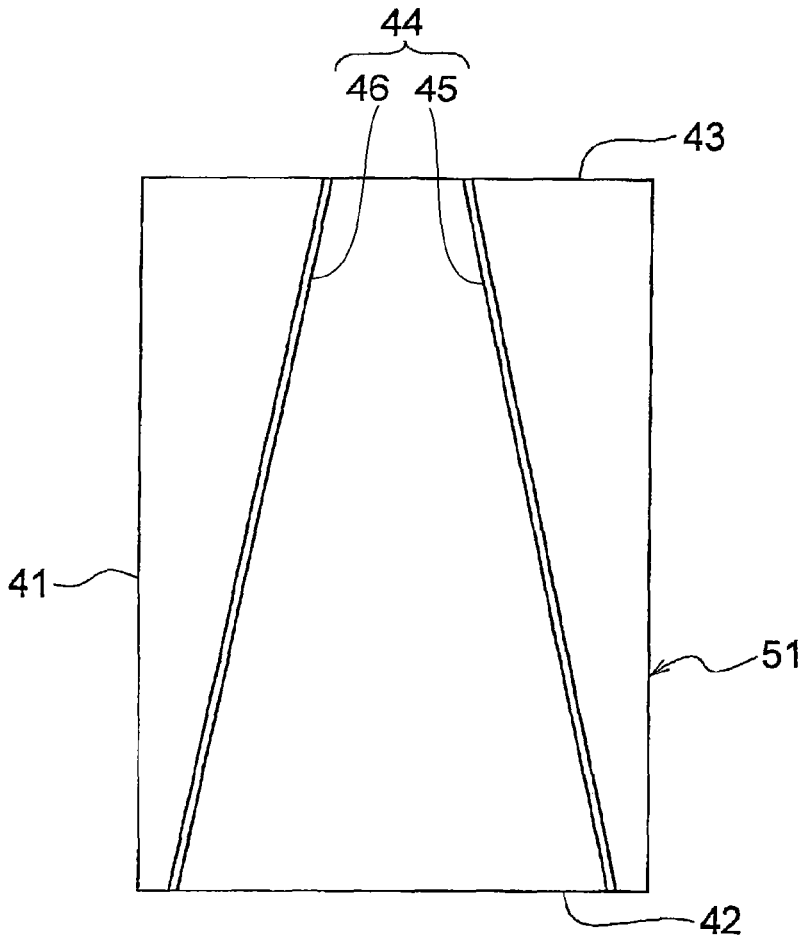
FIG. 6 is a longitudinal sectional view showing one example of an internal structure of a conductive elastic member according to an embodiment of the invention.

FIG. 6 is a longitudinal sectional view showing a cabling structure of a wire rod 44 of a conductive elastic member 51 of Example 2 having another internal structure. In the wire rod 44, plural first wire rods 45 cabled mutually in substantially parallel so as to overlap in a projection direction and plural second wire rods 46 cabled mutually in substantially parallel so as to overlap in the projection direction are respectively cabled inside a columnar member 41 with a rectangular parallelepiped shape along opposed side surfaces of a virtual truncated pyramid extending through the columnar member 41. That is, the first wire rods 45 and the second wire rods 46 are cabled in a state inclined in a direction of intersection mutually in the projection direction. Each of the wire rods 44 is respectively exposed from an upper end face 43 and a lower end face 42 of the conductive elastic member 51 and is arranged.

As shown in FIG. 6, the first wire rods 45 and the second wire rods 46 exposed from the upper end face 43 and the lower end face 42 are arranged symmetrically with respect to a plane including the axis of the conductive elastic member 51, and a ratio between exposed areas of the first wire rods 45 and the second wire rods 46 exposed to the lower end face 42 and the upper end face 43 of each of the columnar members, divided by the plane, in an axial direction is identical in an allowable range. As a result, in the conductive elastic member 51, a region of contact between a first terminal 15 and a second terminal 19 and contact points of the wire rods 44 is ensured widely uniformly.

In Example 2, an upper base side, with a short distance between the first wire rod 45 and the second wire rod 46, of the virtual truncated pyramid is positioned in the upper end face 43, with the result that positions of the first wire rods 45 and the second wire rods 46 exposed from the upper end face 43 can be respectively arranged in the vicinity of the axis of the conductive elastic member 51. Accordingly, tolerance of inclination, a position, etc. of the second terminal 19 in a fitting state can be accommodated more effectively by the conductive elastic member 51. Also, since the first wire rods 45 and the second wire rods 46 are cabled at mutually different angles with respect to the axial direction of the conductive elastic member 51, cabling angles of the first wire rods 45 and the second wire rods 46 are respectively independently changed so as to follow compression of the conductive elastic member 51.

Consequently, even in the case of forming the conductive elastic member 51 as described in Example 2, like the configurations shown in FIGS. 4A to 5B, an area of contact between the first terminal 15 and the second terminal 19 and the contact points can be ensured more than a setting, and contact reliability can be increased.

Figure 7:
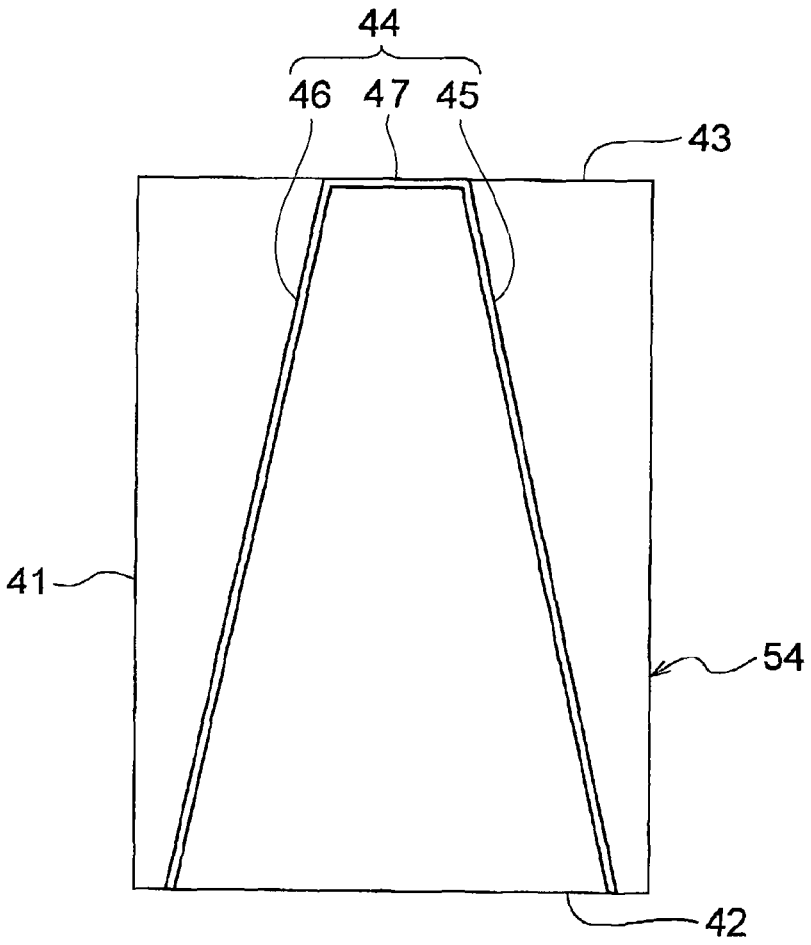
FIG. 7 is a longitudinal sectional view showing one example of an internal structure of a conductive elastic member according to an embodiment of the invention.

Also, the conductive elastic member 51 of FIG. 6 can be formed so as to join the first wire rod 45 and the second wire rod 46 by a third wire rod 47 on the upper base side of the virtual truncated pyramid mutually in each layer like a conductive elastic member 54 shown in FIG. 7. By forming the conductive elastic member 5 in this manner, an area of contact between the second terminal 19 and the wire rods 44 can be ensured more widely on the upper end face 43, with the result that the contact reliability can be increased more.

EXAMPLE 3

Figure 8:
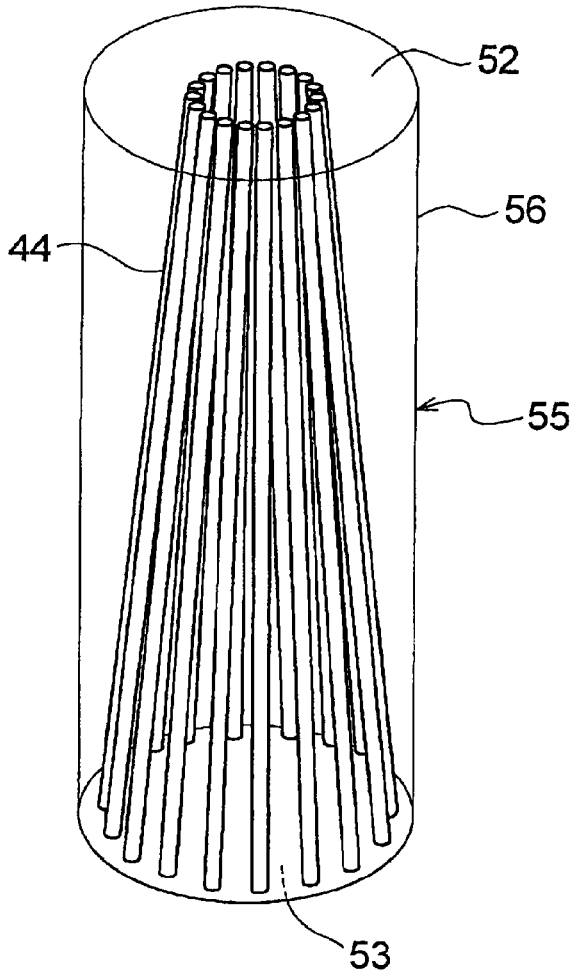
FIG. 8 is a perspective view showing one example of an internal structure of a conductive elastic member.

FIG. 8 is a perspective view of a conductive elastic member 55 of Example 3 having a further internal structure. Wire rods 44 are cabled at substantially equal distances around the axis of a columnar member 56 with a circularly columnar shape along a side surface of a virtual truncated cone extending through the columnar member 56. That is, each of the wire rods 44 is cabled in a direction of mutually intersecting with other wire rods 44.

As shown in FIG. 8, since each of the wire rods 44 exposed from an upper end face 52 and a lower end face 53 is circumferentially arranged around the axis of the conductive elastic member 55, each of the wire rods 44 is arranged symmetrically with respect to a plane including the axis, and a ratio between exposed areas of the wire rods 44 exposed to the upper end face 52 and the lower end face 53 of each of the columnar members, divided by the plane, in an axial direction is identical in an allowable range. As a result, in the conductive elastic member 55, a region of contact between a first terminal 15 and a second terminal 19 and contact points of the wire rods 44 is ensured uniformly around the axis.

Also, in Example 3, since an upper base side of the virtual truncated cone is positioned in the upper end face 52, positions of the wire rods 44 exposed from the upper end face 52 can be arranged in the vicinity of the axis of the conductive elastic member 55. Accordingly, tolerance of inclination, a position, etc. of the second terminal 19 in a fitting state can be accommodated more effectively by the conductive elastic member 55. Further, since each of the wire rods 44 is cabled in a state inclined with respect to the axial direction of the conductive elastic member 55, cabling angles of the wire rods 44 are respectively independently changed so as to follow compression of the conductive elastic member 55.

Consequently, even in the case of forming the conductive elastic member 55 as described in Example 3, an area of contact between the first terminal 15 and the second terminal 19 and the contact points can be ensured more than a setting, and contact reliability can be increased.

Also in Example 3, since the wire rods 44 are cabled around the axis of the conductive elastic member 55, the columnar member 56 can be formed in a circularly columnar shape or a circularly cylindrical shape according to a cabling shape of the wire rods 44. As a result, flexibility of three-dimensional design of the columnar member 56 can be increased.

EXAMPLE 4

Figure 9:
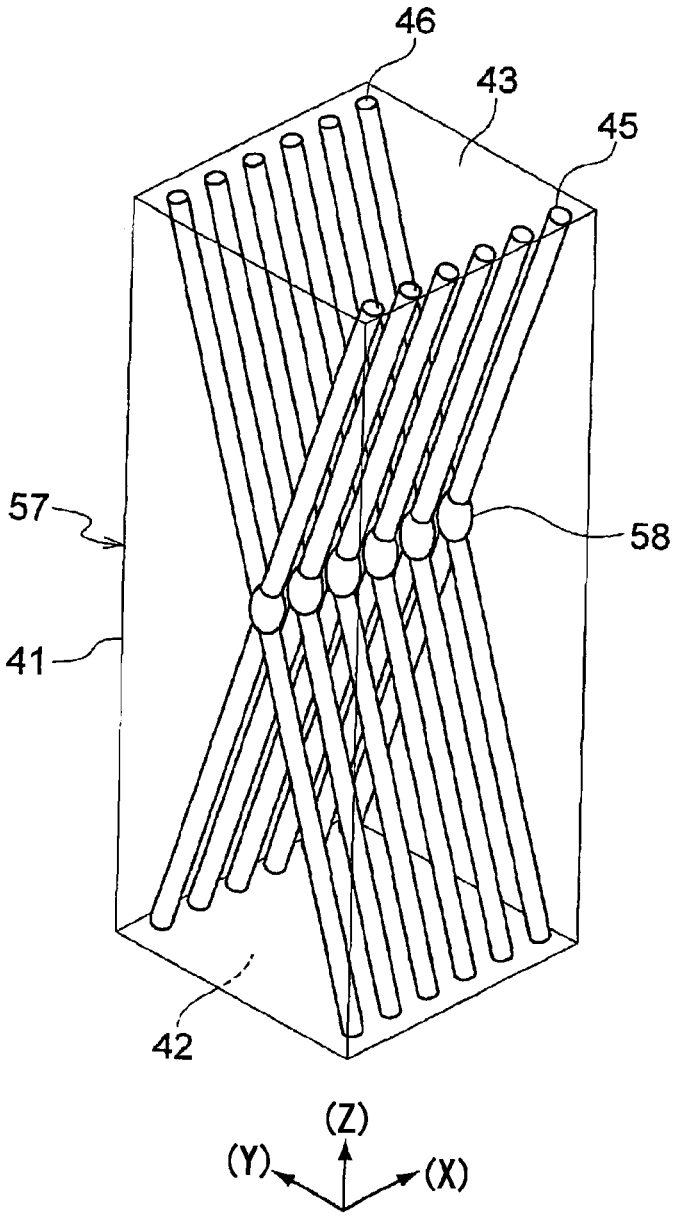
FIG. 9 is a perspective view showing one example of an internal structure of a conductive elastic member.

FIG. 9 is a perspective view of a conductive elastic member 57 of Example 4 having a further internal structure. Inside a columnar member 41 with a rectangular parallelepiped shape, a first wire rod 45 and a second wire rod 46 are coupled by a coupling part 58 and are cabled in an X shape. That is, the first wire rod 45 and the second wire rod 46 are cabled in a direction of intersection mutually in a projection direction.

The coupling part 58 can be formed by mutually intersecting and twisting the first wire rod 45 and the second wire rod 46 and pulling both end sides of the wire rods. The first wire rod 45 and the second wire rod 46 are cabled in the same plane to form one layer, and the adjacent layers are mutually spaced. In addition, a structure of the coupling part 58 is not limited to this example, and the coupling part 58 can also be formed by welding.

By coupling the first wire rod 45 and the second wire rod 46 by the coupling part 58 as described in Example 4, a regulating force in a deformation direction can be increased at the time of compression of the conductive elastic member 57. That is, in the first wire rod 45 and the second wire rod 46, a cabling angle is greatly changed in a (Y) direction, but in an (X) direction, deformation is regulated and the cabling angle is hardly changed. As a result, Example 4 is a structure suitable for, for example, use in which the deformation direction of the conductive elastic member 57 is previously predicted.

Like the configurations shown in FIGS. 4A to 5B, in Example 4, the first wire rods 45 and the second wire rods 46 are arranged symmetrically with respect to a plane including the axis of the conductive elastic member 57, and a ratio between exposed areas of the first wire rods 45 and the second wire rods 46 exposed from a lower end face 42 and an upper end face 43 of each of the columnar members, divided by the plane, in an axial direction is identical in an allowable range. As a result, in the conductive elastic member 57, a region of contact between a first terminal 15 and a second terminal 19 and contact points of wire rods 44 is ensured widely uniformly.

Consequently, even in the case of forming the conductive elastic member 57 as described in Example 4, an area of contact between the first terminal 15 and the second terminal 19 and the contact points can be ensured more than a setting, and contact reliability can be increased.

EXAMPLE 5

Figure 10:
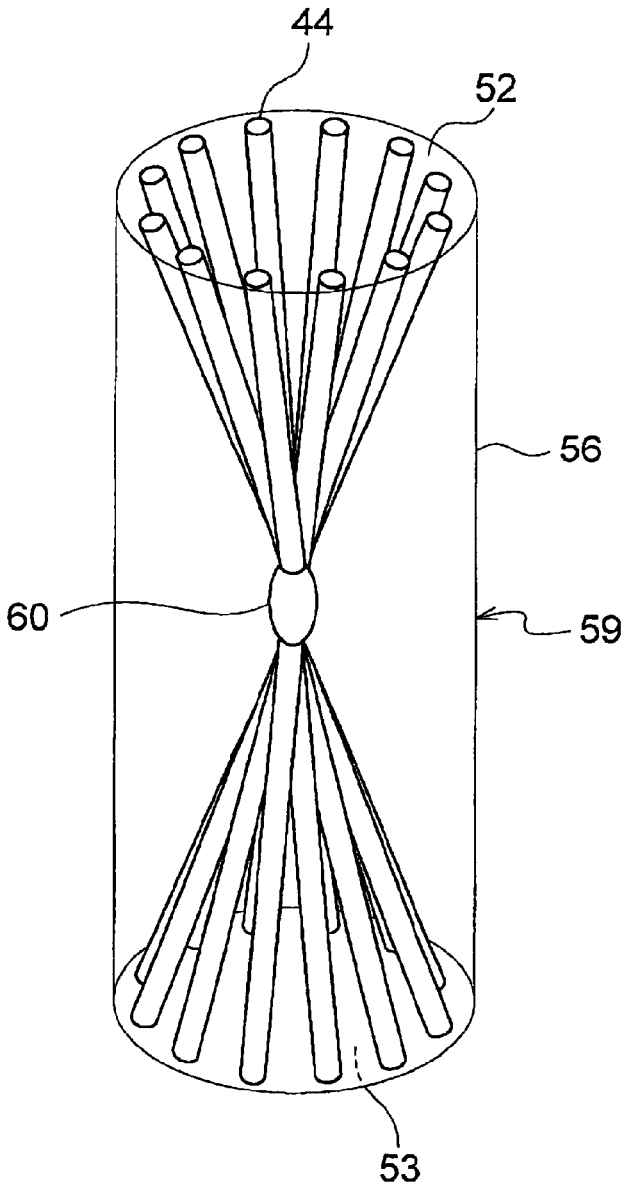
FIG. 10 is a perspective view showing one example of an internal structure of a conductive elastic member.

FIG. 10 is a perspective view of a conductive elastic member 59 of Example 5 having a further internal structure. As shown in FIG. 10, wire rods 44 are mutually fixed at one coupling part 60. In a columnar member 56 with a circularly columnar shape, the wire rods 44 are mutually intersected at the coupling part 60 of the middle of the conductive elastic member 59 in an axial direction, and are respectively cabled in a conical shape from this coupling part 60 toward an upper end face 52 and a lower end face 53.

According to Example 5, the wire rods 44 are not present in a circumferential direction of the coupling part 60, with the result that there is no regulation by the wire rods 44, and the conical wire rods toward the upper end face 52 can be bent and deformed around the coupling part 60 in a three-dimensional direction. Also, the amount of deformation at this time becomes larger than that of other cabling structure. Accordingly, tolerance of inclination, a position, etc. of a second terminal 19 in a fitting state can be accommodated most effectively by the conductive elastic member 59.

Also, a shown in FIG. 10, since each of the wire rods 44 exposed from the upper end face 52 and the lower end face 53 is circumferentially arranged around the axis of the conductive elastic member 59, each of the wire rods 44 is arranged symmetrically with respect to a plane including the axis, and a ratio between exposed areas of the wire rods 44 exposed to the upper end face 52 and the lower end face 53 of each of the columnar members divided by the plane is identical in an allowable range. As a result, in the conductive elastic member 59, a region of contact between a first terminal 15 and the second terminal 19 and contact points of the wire rods 44 is ensured uniformly around the axis.

Consequently, even in the case of forming the conductive elastic member 59 as described in Example 5, an area of contact between the first terminal 15 and the second terminal 19 and the contact points can be ensured more than a setting, and contact reliability can be increased.

Also, according to Example 5, each of the wire rods 44 mutually makes contact through the coupling part 60, with the result that a parallel circuit can be formed and current-carrying resistance of each of the wire rods 44 can be decreased. Moreover, since the wire rods 44 are cabled around the axis of the conductive elastic member 59, the columnar member 56 can be formed in the circularly columnar shape according to a cabling shape of the wire rods 44, and flexibility of three-dimensional design of the columnar member 56 can be increased.

EXAMPLE 6

Figure 11:
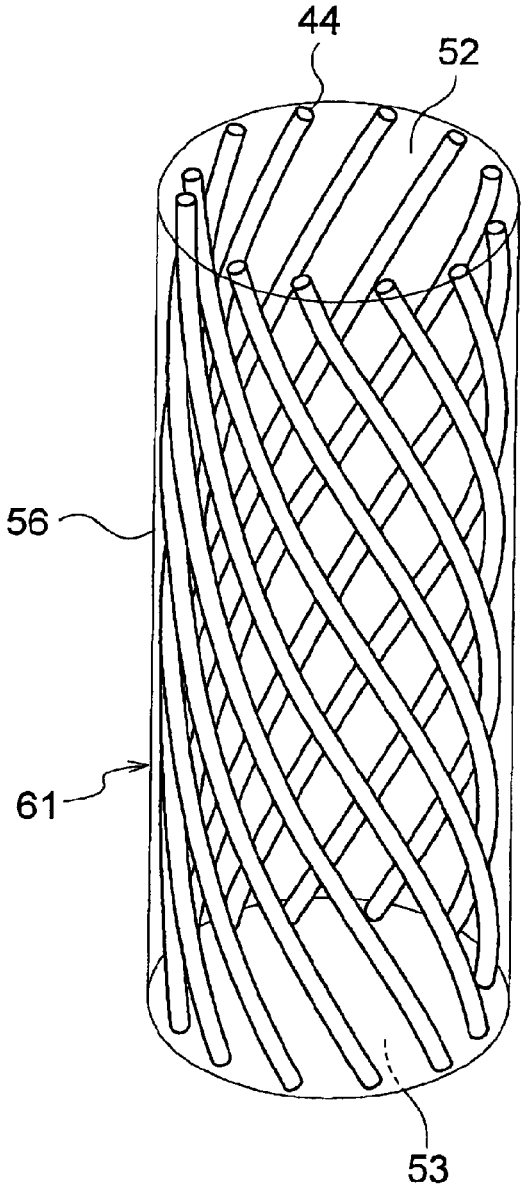
FIG. 11 is a perspective view showing one example of an internal structure of a conductive elastic member.
Figure 12:
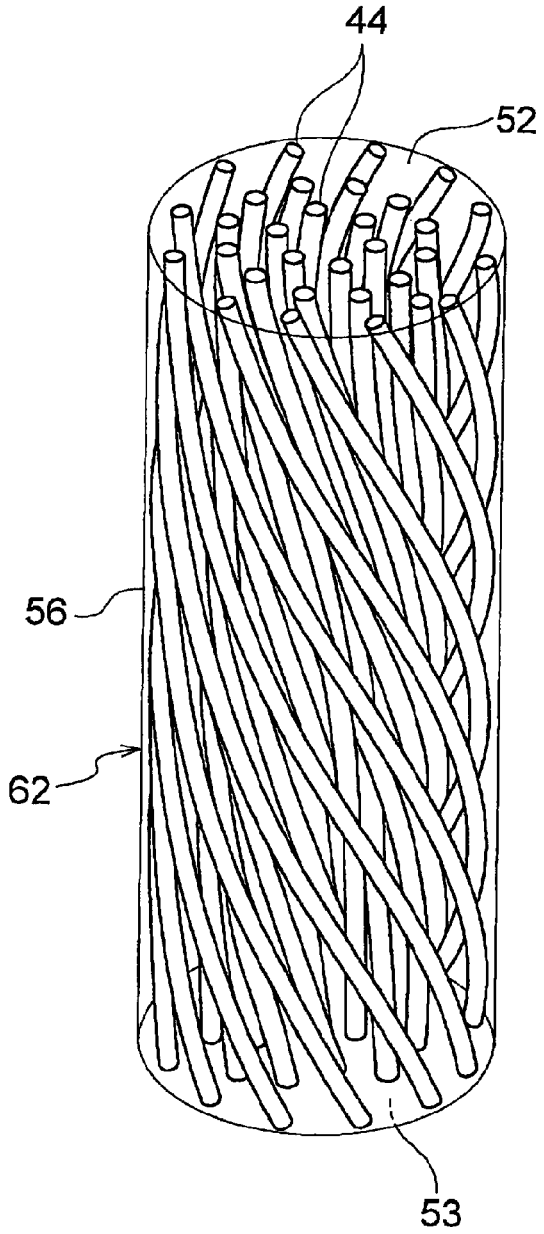
FIG. 12 is a perspective view showing one example of an internal structure of a conductive elastic member.
Figure 13A:
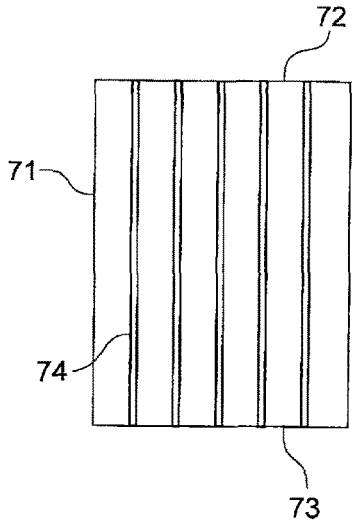
FIGS. 13A and 13B are perspective front views showing one example of an internal structure of a conventional conductive elastic member.
Figure 13B:
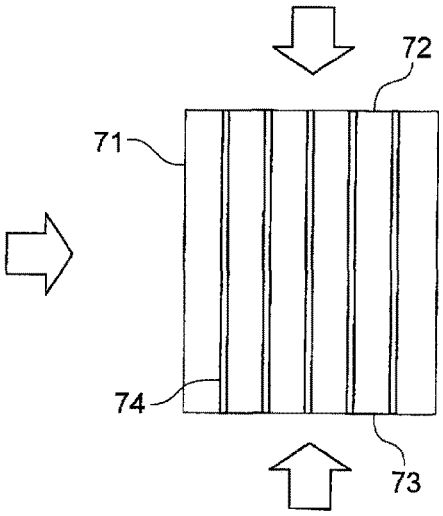
Figure 14A:
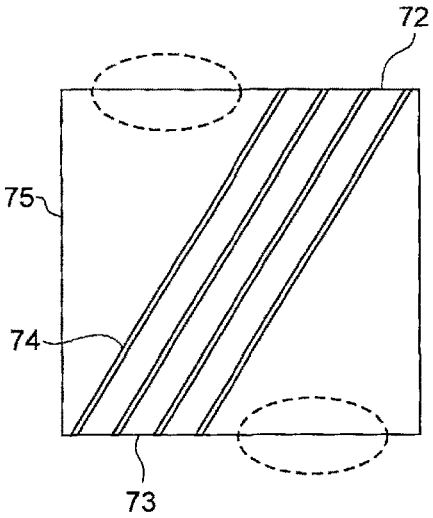
FIGS. 14A and 14B are perspective front views showing one example of an internal structure of a conventional conductive elastic member.
Figure 14B:
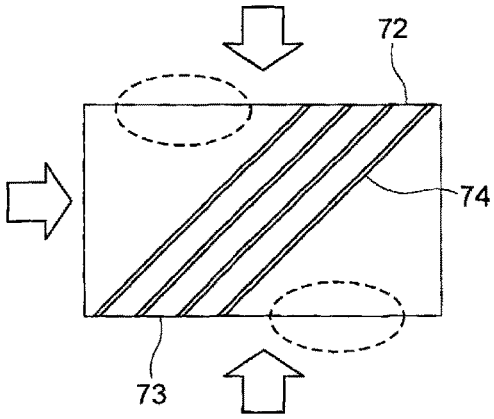

FIG. 11 is a perspective view of a conductive elastic member 61 of Example 6 having a further internal structure. In a columnar member 56 with a circularly columnar shape, wire rods 44 are spirally cabled around the axis of the conductive elastic member 61. In FIG. 11, the spiral wire rods 44 form a circularly cylindrical layer, but as shown in FIG. 12, the circularly cylindrical layers can also be overlapped in a radial direction to form a conductive elastic member 62 cabled in a circularly columnar shape. Each of these wire rods 44 may be cabled in a state mutually intersected with other wire rods 44, or may be cabled without contact with other wire rods 44.

According to Example 6, since each of the wire rods 44 exposed from an upper end face 52 and a lower end face 53 is circumferentially arranged around the axis of each of the conductive elastic members 61, 62, each of the wire rods 44 is arranged symmetrically with respect to a plane including the axis, and a ratio between exposed areas of the wire rods 44 exposed to the upper end face 52 and the lower end face 53 of each of the columnar members divided by the plane is identical in an allowable range. As a result, in each of the conductive elastic members 61, 62, a region of contact between a first terminal 15 and a second terminal 19 and contact points of the wire rods 44 is ensured uniformly around the axis.

Also, in Example 6, since the wire rods 44 are spirally cabled, bending deformation and compressive deformation in an axial direction can be caused to a certain extent. As a result, tolerance of inclination, a position, etc. of a second terminal 19 in a fitting state can be accommodated by each of the conductive elastic members 61, 62. In addition, in the case of FIG. 12, elasticity or flexibility of the conductive elastic member 62 is greatly limited by the many wire rods 44, but the exposed areas of the wire rods 44 exposed from the upper end face 52 and the lower end face 53 can be ensured largely and accordingly, a problem of elasticity or flexibility can be compensated.

Consequently, even in the case of forming each of the conductive elastic members 61, 62 as described in Example 6, an area of contact between the first terminal 15 and the second terminal 19 and the contact points can be ensured more than a setting, and contact reliability can be increased.

The embodiment and Examples of the invention have been described above in detail with reference to the drawings, but the embodiment and Examples described above are only illustration of the invention, and changes and modifications can be made within the scope described in the claims.

For example, the cabling structure of the wire rods 44 is not limited to each of the cabling structures described above as long as in the case of being divided by the a plane including the axis of the conductive elastic member, the ratio between exposed areas of the wire rods exposed to both of the end faces of each of the divided columnar members in the axial direction is identical in the allowable range. Here, the allowable range can properly be set based on, for example, an allowable range of a change in temperature of the conductive elastic member, or a reference value of the area of contact between the second terminal 19 and the contact points of the wire rods 44 corresponding to the tolerance range of inclination of the second terminal 19 in the fitting state.

Also, each of Examples described above only shows the basic cabling structure of the wire rods 44, and in the actual conductive elastic member, at least a part of all the wire rods 44 could form the cabling structure described above and also, the cabling structure described above can be overlapped three-dimensionally, or the different cabling structures can be combined.

Also, in each of Examples described above, the conductive elastic member is formed in the rectangular parallelepiped shape, the circularly columnar shape or the circularly cylindrical shape and in all the cases, the axial direction is set in a longitudinal direction, but the conductive elastic member of the invention is not limited to this, and a radial direction can also be set in the longitudinal direction.

Here, the features of the embodiment of the conductive elastic member and the connector according to the invention described above will be briefly summarized and listed in the following to, respectively.

A conductive elastic member (20) comprising:

a columnar member (41) having elasticity, and plural wire rods (44) having conductivity, extending from one end face (a lower end face 42) to the other end face (an upper end face 43) of the columnar member (41) in an axial direction thereof, and inclined with respect to the axial direction, wherein the wire rods (44) have plural first wire rods (45) and second wire rods (46) cabled in parallel mutually along a direction substantially orthogonal to the axial direction, and the first wire rods (45) and the second wire rods (46) are respectively cabled along opposed side surfaces of a virtual truncated pyramid extending through the columnar member (41), and each of the wire rods of the first wire rods (45) and each of the wire rods of the second wire rods (46) are respectively formed so as to be joined on an upper base side of the virtual truncated pyramid by third wire rods (47) cabled along the other end face.

A conductive elastic member (20) comprising:

a columnar member (41) having elasticity, and plural wire rods (44) having conductivity, extending from one end face (a lower end face 42) to the other end face (an upper end face 43) of the columnar member (41) in an axial direction thereof, and inclined with respect to the axial direction, wherein the wire rods (44) are cabled along a side surface of a virtual truncated cone extending through the columnar member (56).

A conductive elastic member (20) comprising:

a columnar member (41) having elasticity, and plural wire rods (44) having conductivity, extending from one end face (a lower end face 42) to the other end face (an upper end face 43) of the columnar member (41) in an axial direction thereof, and inclined with respect to the axial direction, wherein the wire rods (44) are mutually intersected in a middle of the columnar member (56) in the axial direction and are respectively cabled in a conical shape from the intersected portion (a coupling part 60) toward both of the end faces (an upper end face 52 and a lower end face 53).

The conductive elastic member according to the above wherein, when the columnar member (41) is divided by a plane (L) including an axis, a ratio between exposed areas of the wire rods (the first wire rods 45 and the second wire rods 46) exposed to both of the end faces (the lower end face 42 and the upper end face 43) of each of the divided columnar members in the axial direction is identical in an allowable range.

A connector (11) comprising:

a first housing (21) for holding one terminal (a first terminal 15);

a second housing (31) for holding the other terminal (a second terminal 19); and a conductive elastic member (20) accommodated in one of the first housing (21) and the second housing (31), wherein when the first housing (21) is fitted into the second housing (31), the conductive elastic member (20) comes in contact with the one terminal (the first terminal 15) and the other terminal (the second terminal 19) so as to electrically connect the one terminal (the first terminal 15) and the other terminal (the second terminal 19) through the conductive elastic member (20), and the conductive elastic member (20) is the conductive elastic member (20, 51, 54, 55, 57, 59, 61, 62) as described in any one of the above to.

According to the conductive elastic member of the present invention, the wire rods are cabled in the direction of intersection mutually and thereby, an exposed region, that is, a contact point region of the wire rods exposed from the end faces of the columnar member can widely be ensured on the end faces. Also, each of the wire rods is respectively formed in the state inclined with respect to the axial direction and an inclination of each of the wire rods is changed so as to follow compression of the columnar member, with the result that the conductive elastic member can be compressed and deformed, and a terminal can uniformly be pressed on each of the end faces. Accordingly, since an area of contact between the terminal and contact points of the wire rods can be ensured widely, reliability of contact between the terminal and the contact points can be increased.

According to the conductive elastic member of the present invention, the ratio between the exposed areas of each of the end faces at the time when the columnar member is divided by the plane including the axis is identical in the allowable range and thereby, the wire rods can be distributed and exposed substantially equally around the axis of the end face. Accordingly, since a deviation of a contact point region of the wire rods on the end faces can be prevented, reliability of contact between a terminal and contact points can be increased.

According to the conductive elastic member of the present invention, since angles of the first wire rod and the second wire rod are changed in a situation in which the conductive elastic member follows compressive deformation of the columnar member, flexibility can be obtained. In this case, the first wire rod and the second wire rod may be mutually spaced and cabled in the direction substantially orthogonal to the axial direction, but the first wire rod and the second wire rod are mutually intersected and cabled and thereby, a parallel circuit is formed and current-carrying resistance can be decreased.

According to the conductive elastic member of the present invention, since each of the wire rods can form a contact point so as to surround the axis in the vicinity of the end face of the conductive elastic member, contact with a terminal can be ensured more, and reliability of contact between the terminal and the wire rods can be increased more.

According to the conductive elastic member of the present invention, since the columnar member can be deformed freely in a desired direction around the intersected portion of the plural wire rods, contact between the terminal and the end face can be made more uniformly. Also, since the wire rods are uniformly formed around the axis, flexibility of a three-dimensional shape of the columnar member can be increased.

According to the conductive elastic member of the present invention, since the number of wire rods cabled in the columnar member can be increased easily, an exposed area ratio of the wire rods on the end face of a terminal connecting member can be increased, and reliability of contact between a terminal and the wire rods can be increased.

A conductive elastic member and a connector of the invention can increase reliability of contact between a terminal and wire rods of the conductive elastic member in various connecting devices for making connection between the terminals of various electrical devices.

What is claimed is:

1. A conductive elastic member comprising:

a columnar member having elasticity; and plural wire rods having conductivity, extending from one end face to the other end face of the columnar member in an axial direction thereof, and inclined with respect to the axial direction, wherein the wire rods have plural first wire rods and second wire rods cabled in parallel mutually along a direction substantially orthogonal to the axial direction, the first wire rods and the second wire rods are respectively cabled along opposed side surfaces of a virtual truncated pyramid extending through the columnar member, and each of the wire rods of the first wire rods and each of the wire rods of the second wire rods are respectively formed so as to be joined on an upper base side of the virtual truncated pyramid by third wire rods cabled along the other end face.

2. A connector comprising:

a first housing for holding one terminal;

a second housing for holding the other terminal; and a conductive elastic member accommodated in one of the first housing and the second housing, wherein, when the first housing is fitted into the second housing, the conductive elastic member comes in contact with the one terminal and the other terminal so as to electrically connect the one terminal and the other terminal through the conductive elastic member, and the conductive elastic member is the conductive elastic member according to claim 1.

3. A conductive elastic member comprising:

a columnar member having elasticity; and plural wire rods having conductivity, extending from one end face to the other end face of the columnar member in an axial direction thereof, and inclined with respect to the axial direction, wherein the wire rods are cabled along a side surface of a virtual truncated cone extending through the columnar member.

4. A connector comprising:

a first housing for holding one terminal;

a second housing for holding the other terminal; and a conductive elastic member accommodated in one of the first housing and the second housing, wherein, when the first housing is fitted into the second housing, the conductive elastic member comes in contact with the one terminal and the other terminal so as to electrically connect the one terminal and the other terminal through the conductive elastic member, and the conductive elastic member is the conductive elastic member according to claim 3.

5. A conductive elastic member comprising:

a columnar member having elasticity; and plural wire rods having conductivity, extending from one end face to the other end face of the columnar member in an axial direction thereof, and inclined with respect to the axial direction, wherein the wire rods are mutually intersected in a middle of the columnar member in the axial direction and are respectively cabled in a conical shape from the intersected portion toward both of the end faces.

6. The conductive elastic member according to claim 5, wherein, when the columnar member is divided by a plane including an axis, a ratio between exposed areas of the wire rods exposed to both of the end faces of each of the divided columnar members in the axial direction is identical in an allowable range.

7. A connector comprising:

a first housing for holding one terminal;

a second housing for holding the other terminal; and a conductive elastic member accommodated in one of the first housing and the second housing, wherein, when the first housing is fitted into the second housing, the conductive elastic member comes in contact with the one terminal and the other terminal so as to electrically connect the one terminal and the other terminal through the conductive elastic member, and the conductive elastic member is the conductive elastic member according to claim 6.

8. A connector comprising:

a first housing for holding one terminal;

a second housing for holding the other terminal; and a conductive elastic member accommodated in one of the first housing and the second housing, wherein, when the first housing is fitted into the second housing, the conductive elastic member comes in contact with the one terminal and the other terminal so as to electrically connect the one terminal and the other terminal through the conductive elastic member, and the conductive elastic member is the conductive elastic member according to claim 5.

* * * * *